US009120548B2

(12) United States Patent
Nakayasu

(10) Patent No.: US 9,120,548 B2
(45) Date of Patent: Sep. 1, 2015

(54) MARINE VESSEL STEERING SYSTEM

(71) Applicant: Yamaha Hatsudoki Kabushiki Kaisha, Iwata-shi, Shizuoka (JP)

(72) Inventor: Yoshikazu Nakayasu, Shizuoka (JP)

(73) Assignee: Yamaha Hatsudoki Kabushiki Kaisha, Shizouka (JP)

( * ) Notice: Subject to any disclaimer, the term of this patent is extended or adjusted under 35 U.S.C. 154(b) by 109 days.

(21) Appl. No.: 14/048,270

(22) Filed: Oct. 8, 2013

(65) Prior Publication Data

US 2014/0106632 A1 Apr. 17, 2014

(30) Foreign Application Priority Data

Oct. 16, 2012 (JP) ..... 2012-228657

(51) Int. Cl.
*B63H 21/21* (2006.01)
*B63H 20/12* (2006.01)
*B63H 20/00* (2006.01)

(52) U.S. Cl.
CPC ..... *B63H 21/21* (2013.01); *B63H 20/12* (2013.01); *B63H 2020/003* (2013.01)

(58) Field of Classification Search
CPC ..... B63H 21/21; B63H 20/12
USPC ..... 440/1, 53; 701/21
See application file for complete search history.

(56) References Cited

U.S. PATENT DOCUMENTS 7,429,202 B2 * 9/2008 Yazaki et al. ..... 440/53
7,505,836 B2 * 3/2009 Okuyama et al. ..... 701/21
7,507,130 B2 * 3/2009 Watanabe et al. ..... 440/84
7,524,218 B2 * 4/2009 Okuyama ..... 440/1
7,527,537 B2 * 5/2009 Mizutani ..... 440/53
7,527,538 B2 * 5/2009 Mizutani ..... 440/61 S
7,559,812 B2 * 7/2009 Yamada et al. ..... 440/2
7,677,937 B2 * 3/2010 Ishida et al. ..... 440/1
8,060,265 B2 * 11/2011 Hallenstvedt et al. ..... 701/21
8,113,892 B1 * 2/2012 Gable et al. ..... 440/84
8,272,906 B2 * 9/2012 Ito ..... 440/1
8,340,846 B2 * 12/2012 Mizutani et al. ..... 701/21
8,460,040 B2 * 6/2013 Ito ..... 440/1
8,577,523 B2 * 11/2013 Zanfei ..... 701/21
2006/0166567 A1 * 7/2006 Otobe et al. ..... 440/1
2006/0240720 A1 * 10/2006 Yamashita et al. ..... 440/1
2007/0093147 A1 * 4/2007 Mizutani ..... 440/1

(Continued)

FOREIGN PATENT DOCUMENTS

JP 2006-199189 A 8/2006
JP 2006-298233 A 11/2006
JP 2010-173447 A 8/2010

*Primary Examiner* — Lars A Olson
*Assistant Examiner* — Jovon Hayes
(74) *Attorney, Agent, or Firm* — Keating & Bennett, LLP

(57) ABSTRACT

A marine vessel steering system includes a basic target turning angle computing unit that computes a basic target turning angle δo* common to two outboard motors based on a steering angle θ detected by a steering angle sensor. A traveling state determining unit determines whether a traveling state of a marine vessel is a straight traveling state based on the received basic target turning angle δo*. When the traveling state of the marine vessel is determined as being the straight traveling state, a target turning angle computing unit determines, based on the basic target steering angle δo* and a straight traveling toe angle φs stored in a nonvolatile memory, target turning angles δ* of the two outboard motors such that a toe angle between the two outboard motors is equal to the straight traveling toe angle φs.

18 Claims, 7 Drawing Sheets

(56) References Cited

U.S. PATENT DOCUMENTS

2007/0105463 A1* 5/2007 Mizutani ..... 440/61 S
2007/0207683 A1* 9/2007 Mizutani ..... 440/53
2011/0028057 A1* 2/2011 Torrangs et al. ..... 440/53
2012/0016543 A1* 1/2012 Zanfei ..... 701/21
2014/0106632 A1* 4/2014 Nakayasu ..... 440/1

* cited by examiner

MARINE VESSEL STEERING SYSTEM

BACKGROUND OF THE INVENTION

1. Field of the Invention

The present invention relates to a marine vessel steering system for a marine vessel with two outboard motors.

2. Description of the Related Art

An outboard motor is an example of a propulsion device for a marine vessel and includes a motor and a propeller driven by the motor. The outboard motor is attached to a stern of the marine vessel in a state enabling turning in the right and left directions. The marine vessel is equipped with a steering apparatus to control a turning angle of the outboard motor. The steering apparatus turns the outboard motor in accordance with an operation of a steering handle by a marine vessel operator. In a case of a multiple installation arrangement in which a plurality of outboard motors are installed at the stern, the steering apparatus turns the plurality of outboard motors in synchronization.

U.S. 2007/0207683 A1 discloses a marine vessel that includes two outboard motors, electric motors to steer the respective outboard motors, and a controller that controls the electric motors. The two outboard motors are aligned and attached along a stern of a hull. The controller changes a relative angle (toe angle) between the two outboard motors at neutral positions (straight positions) in accordance with a traveling state of the marine vessel and, with the changed toe angle, performs a turning angle control in accordance with the steering handle operation.

Here, the toe angle refers to an angle $\phi$ defined by mutually straight lines extending along propulsive force directions of the two outboard motors 3P and 3S as shown in FIG. 8A or FIG. 8B. The toe angle indicates whether front ends of the two outboard motors 3P and 3S are directed inward or outward with respect to a heading direction of the marine vessel 1 when the marine vessel 1 is viewed from above. A toe angle in a case where the front ends of the two outboard motors 3P and 3S are directed inward with respect to the heading direction as shown in FIG. 8A is referred to as a "toe-in" angle. A toe angle in a case where the front ends of the two outboard motors 3P and 3S are directed outward with respect to the heading direction as shown in FIG. 8B is referred to as a "toe-out" angle. In the preferred embodiments of the present invention, a toe-out angle shall be expressed as being positive (+) and a toe-in angle shall be expressed as being negative (−).

With the prior art described in U.S. 2007/0207683 A1, a top speed mode (a traveling mode in which the speed is maximized) and an acceleration mode (a traveling mode in which acceleration to a predetermined speed is performed in a minimum time) are defined in advance and the related characteristic engine toe angles are identified and stored in the controller as traveling performance modes. Also, a traveling state detecting device for detecting the speed, acceleration, etc., is provided. When a marine vessel operator selects one mode from among the traveling performance modes prepared in advance, the controller sets a target toe angle based on a target traveling performance corresponding to the selected traveling performance mode, a traveling state detected by the traveling state detecting device, etc. The controller then controls the electric motors so that the toe angle is equal to the set target toe angle.

Operation in a case where the top speed mode is selected shall now be described specifically. A top speed mode map, etc., expressing a relationship between the speed and toe angle in the case where the top speed mode is selected, are stored in advance. When the top speed mode is selected, a toe angle, which, among the toe angles stored in the top speed mode map, corresponds to the speed detected by the traveling state detecting device, is set as the target toe angle and the electric motors are controlled so that the toe angle is equal to the set target toe angle.

With the marine vessel controlled so that the toe angle between the two outboard motors becomes equal to the target toe angle, even during straight traveling of the marine vessel, an external force acting so as to prevent the toe angle from becoming equal to the target toe angle acts on both outboard motors due to a water stream generated at a periphery of the marine vessel. Thus, to maintain the toe angle between the two outboard motors at the target toe angle against the external force during straight travel, the electric motors must be made to generate motor torques of magnitudes enough to cope with the external force. Thus, the required motor torque increases with the external force. Therefore, due to the manner in which an electric motor operates, the current required to supply the electric motor, i.e. the electric consumption, increases when the external force increases.

SUMMARY OF THE INVENTION

Preferred embodiments of the present invention provide a marine vessel steering system that enables an external force that acts on two outboard motors during straight travel of a marine vessel to be reduced and thus enables a significant reduction of the consumption of power during straight travel.

In order to overcome the previously unrecognized and unsolved challenges described above, a first preferred embodiment of the present invention provides a steering system for a marine vessel that includes two outboard motors, each including a motor and a propeller rotated by the motor, the marine vessel steering system including a steering member, two turning mechanisms respectively arranged to turn the two outboard motors individually and each including an electric motor driven in accordance with an operation of the steering member, and a motor control unit arranged and programmed to control the two electric motors so that, during straight traveling of the marine vessel, a toe angle between the two outboard motors is equal to a straight traveling toe angle set in advance, and the straight traveling toe angle is set to an angle such that electric currents flowing through the two electric motors during the straight traveling of the marine vessel are significantly reduced or minimized. "Motor" herein refers inclusively to an internal combustion engine, electric motor, etc.

According to this arrangement, during the straight traveling of the marine vessel, the two electric motors are controlled so that the toe angle between the two outboard motors is equal to the straight traveling toe angle set in advance. The straight traveling toe angle is set to the angle such that the electric currents flowing through the two electric motors respectively provided in the two turning mechanisms during the straight traveling of the marine vessel are significantly reduced or minimized. The electric currents flowing through the electric motors during the straight traveling of the marine vessel correspond to an external force that acts on the outboard motors during the straight traveling. The toe angle at which the electric currents are significantly reduced or minimized is thus a toe angle at which the external force acting on the outboard motors is of a magnitude close to or at the minimum. The consumption of power during the straight traveling of the marine vessel can thus be significantly reduced. Also, the external force acting on the respective outboard motors can be of a magnitude close to or at the minimum during the straight traveling of the marine vessel so that the performance of the entire outboard motor is greatly improved.

The marine vessel steering system may further include a steering angle detecting unit arranged to detect a steering angle of the steering member, actual turning angle detecting units arranged to detect actual turning angles of the respective outboard motors, and a basic target turning angle computing unit arranged and programmed to compute a basic target turning angle based on the steering angle detected by the steering angle detecting unit.

In this case, the motor control unit preferably includes a traveling state determining unit arranged to determine whether or not the traveling state of the marine vessel is the straight traveling state, a target turning angle computing unit arranged and programmed to compute target turning angles of the respective outboard motors based on the determination result of the traveling state determining unit and the basic target turning angle computed by the basic target turning angle computing unit, and a feedback control unit arranged and programmed to control the respective electric motors so that the actual turning angles of the respective outboard motors detected by the actual turning angle detecting unit approach the target turning angles of the corresponding outboard motors computed by the target turning angle computing unit.

Preferably, when the traveling state determining unit determines that the traveling state is the straight traveling state, the target turning angle computing unit computes, based on the basic target turning angle computed by the basic target turning angle computing unit and the straight traveling toe angle, the target turning angles of the respective outboard motors such that the toe angle between the two outboard motors is equal to the straight traveling toe angle. Further preferably, when the traveling state determining unit determines that the traveling state is not the straight traveling state, the target turning angle computing unit computes the target turning angles of the respective outboard motors based on the basic target turning angle computed by the basic target turning angle computing unit.

The traveling state determining unit is preferably arranged to determine whether or not the traveling state is the straight traveling state based on whether or not the basic target turning angle computed by the basic target turning angle computing unit is within a predetermined angular range that has been set in advance.

The marine vessel steering system may include current detecting units arranged to detect the electric currents of the respective electric motors, a current value outputting unit arranged to display or externally output the motor current values detected by the respective current detecting units, and a toe angle setting/changing unit arranged to set or change the straight traveling toe angle.

According to this arrangement, it becomes possible to monitor the electric currents flowing through the respective electric motors while making the marine vessel undergo straight travel. The straight traveling toe angle can then be set or changed so that the electric currents with respect to a plurality of different straight traveling toe angles can be monitored. By using the monitoring results, the straight traveling toe angle at which the electric currents flowing through the two electric motors during straight traveling are significantly reduced or minimized can be determined and the straight traveling toe angle can be set. A marine vessel steering system with which the power consumption during straight traveling is significantly reduced is thus provided.

The angle, at which the electric currents flowing through the electric motors are significantly reduced or minimized, may be a toe-in angle, with which front ends of both outboard motors are directed inward.

A cross-section perpendicular to a front/rear direction of the marine vessel, at a hull bottom of a rear portion of a hull of the marine vessel preferably has a V-shape, for example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
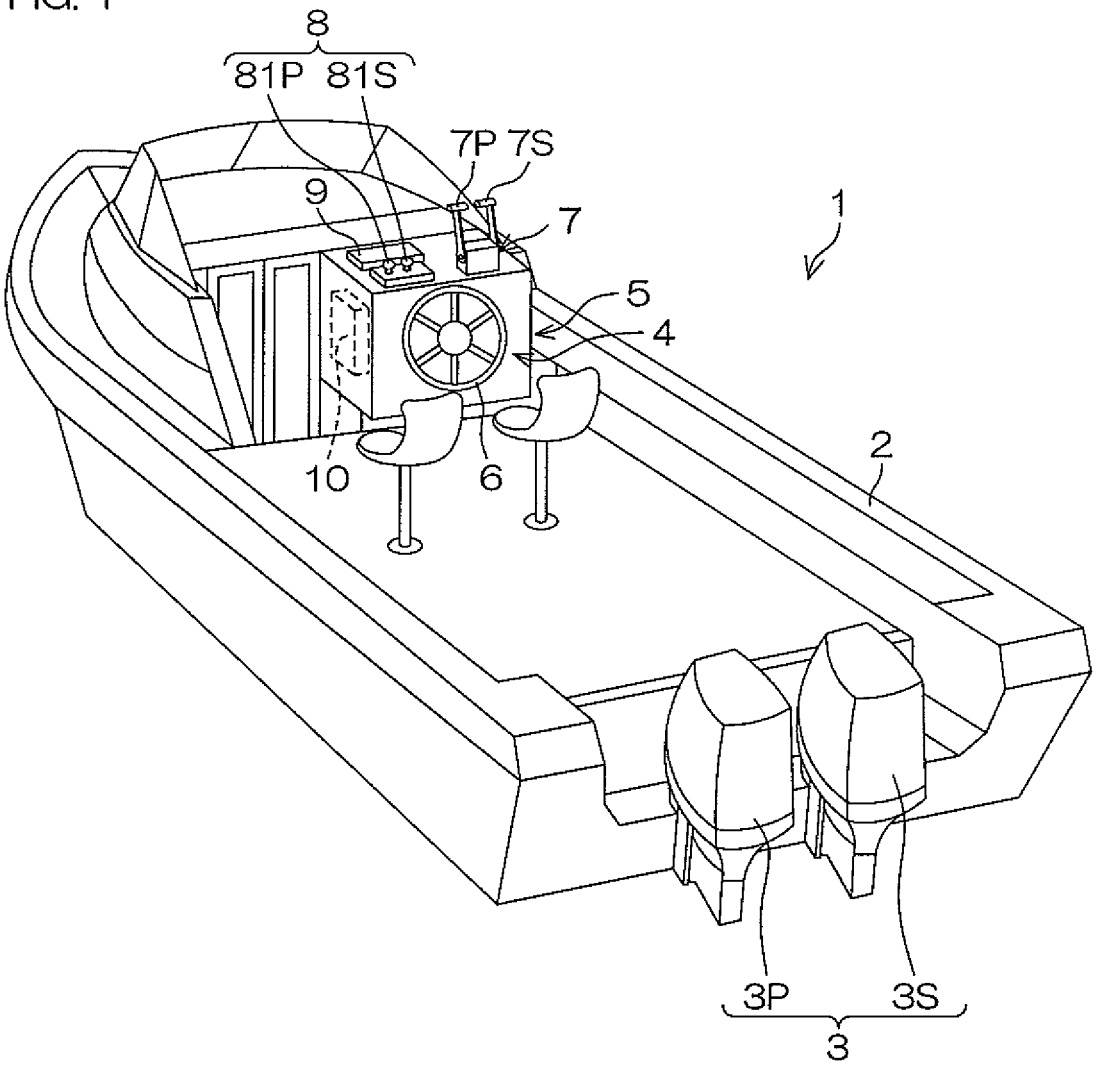
FIG. 1 is a perspective view illustrating an arrangement of a marine vessel according to a preferred embodiment of the present invention.
Figure 2:
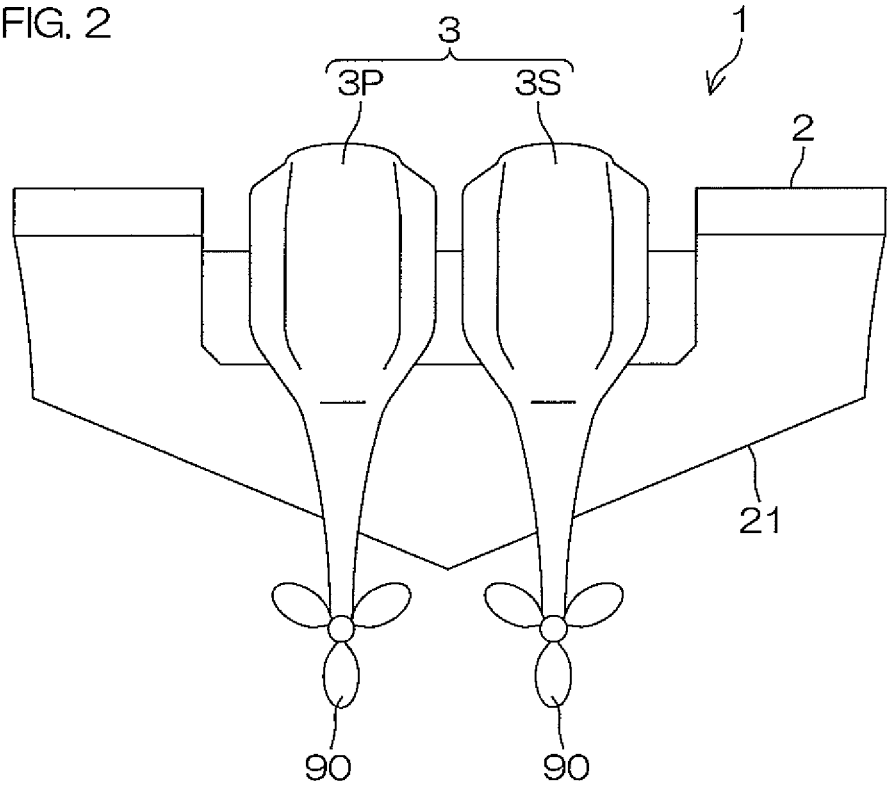
FIG. 2 is a rear view of the marine vessel.

FIG. 1 is a perspective view illustrating an arrangement of a marine vessel according to a preferred embodiment of the present invention. FIG. 2 is a rear view of the marine vessel of FIG. 1. The marine vessel 1 includes a hull 2, a plurality of outboard motors 3 as marine vessel propulsion devices, and a steering apparatus 4 that controls turning angles of the respective outboard motors 3. Two outboard motors 3 are preferably provided in the present preferred embodiment. The outboard motors 3 are aligned and attached along a stern of the hull 2 and are arranged to swing (turn) in the right and left directions. When the two outboard motors are to be distinguished, the outboard motor disposed at a starboard side shall be referred to as the "starboard outboard motor 3S" and the outboard motor disposed at a port side shall be referred to as the "port outboard motor 3P." Each of the outboard motors 3 includes an engine (internal combustion engine as an example of a motor) and a propeller (screw) and generates a propulsive force by rotation of the propeller by a driving force of the engine. In the present preferred embodiment, a cross-section perpendicular to a front/rear direction of the marine vessel at a hull bottom 21 of a rear portion of the hull 2 has a V-shape as shown in FIG. 2.

A marine vessel operator compartment 5 is provided at a front portion (stem side) of the hull 2. The marine vessel operator compartment 5 includes a steering handle 6 as a steering member, a remote controller 7, an operation panel 8, an operation display portion 9, and a main ECU (electronic control unit) 10.

Figure 4:
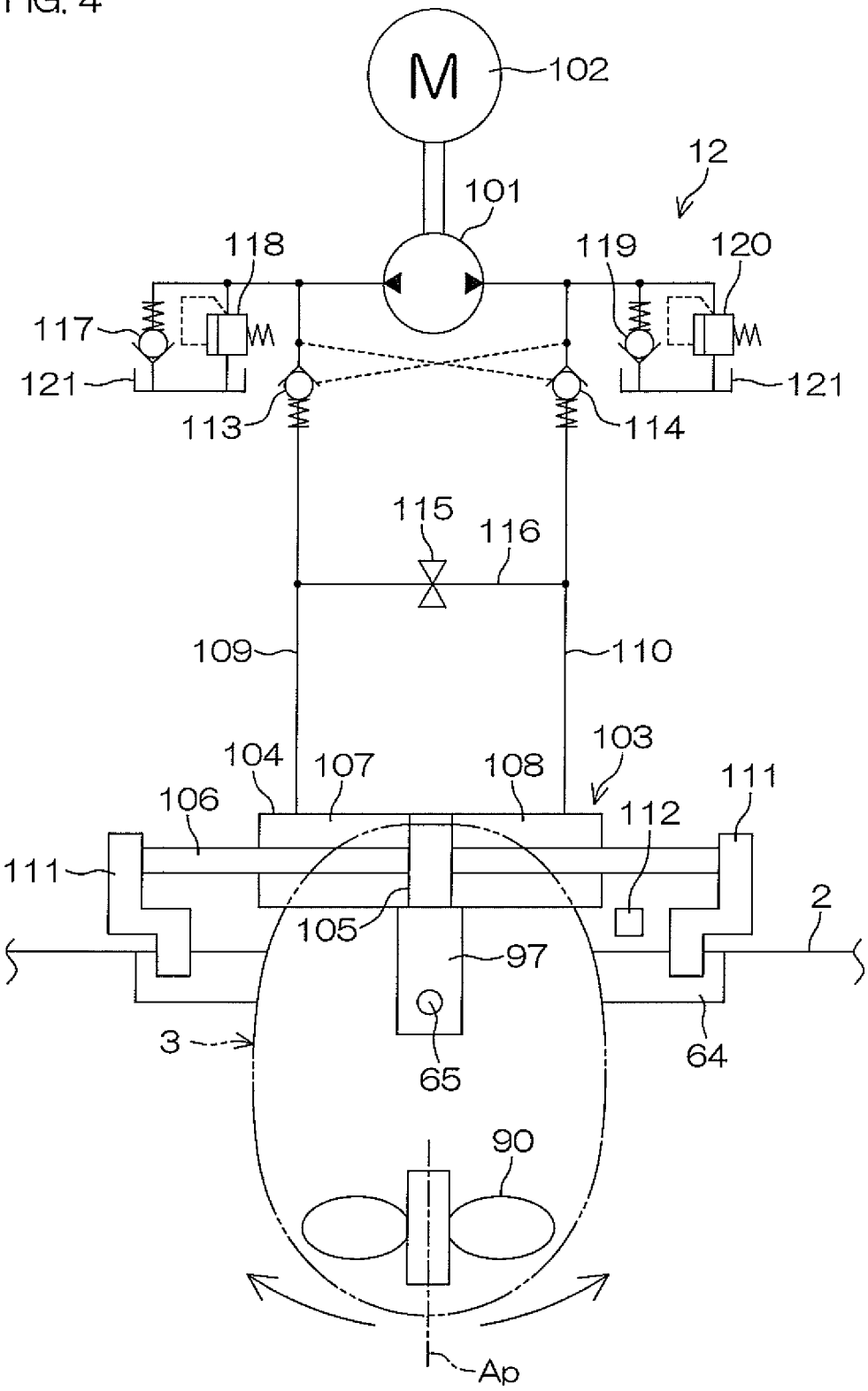
FIG. 4 is an arrangement diagram illustrating an arrangement example of a turning mechanism.
Figure 5:
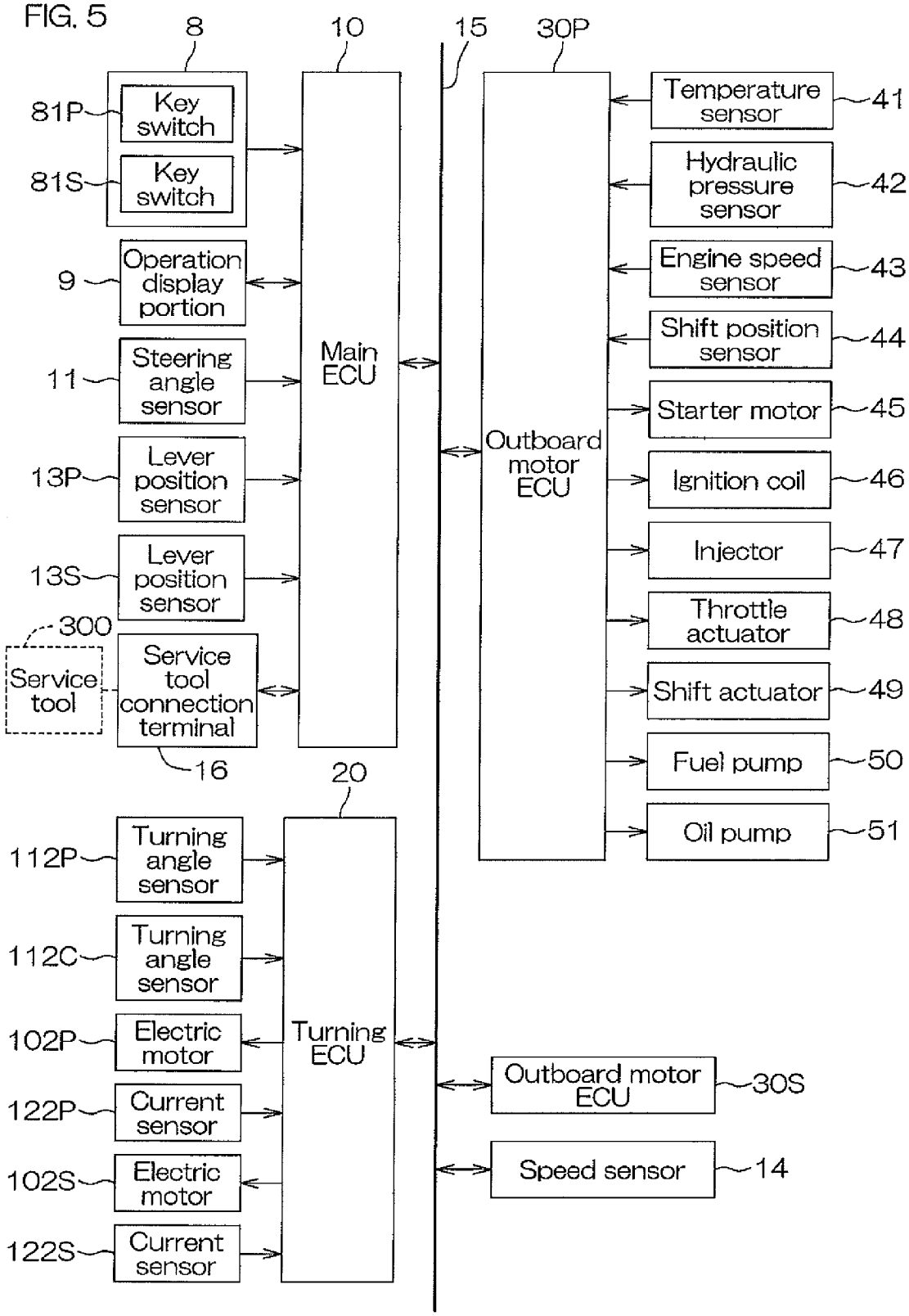
FIG. 5 is a block diagram illustrating an electrical arrangement of a principal portion of the marine vessel.

A steering angle of the steering handle 6 is detected by a steering angle sensor 11 (see FIG. 5). Also, two turning mechanisms 12 (see FIG. 3 and FIG. 4), respectively corresponding to the two outboard motors 3, are provided at the stern. Each turning mechanism 12 includes an electric motor 102 (see FIG. 4) as a turning actuator driven in accordance with the steering angle detected by the steering angle sensor 11. The electric motors 102 of the two turning mechanisms 12 are controlled by a turning ECU 20 (see FIG. 5).

The steering apparatus 4 includes the steering handle 6, the steering angle sensor 11, the main ECU 10, the turning ECU 20, the two turning mechanisms 12, two turning angle sensors 112 (see FIG. 4 and FIG. 5) to be described below, etc. Due to the turning angle of each outboard motor 3 being controlled by the steering apparatus 4, a direction of the propulsive force is changed and a heading direction of the marine vessel 1 is changed accordingly.

The remote controller 7 includes two levers, i.e., right and left levers 7P and 7S. Each of these levers 7P and 7S can be inclined forward and rearward. When the two levers 7P and 7S are to be distinguished, the lever disposed at a left side facing the stem shall be referred to as the "left lever 7P" and the lever disposed at the right side facing the stem shall be referred to as the "right lever 7S."

Inclination positions of the levers 7P and 7S are respectively detected by potentiometers or other lever position sensors 13P and 13S (see FIG. 5). The lever position sensor 13P corresponds to the left lever 7P and the lever position sensor 13S corresponds to the right lever 7S.

The operation display portion 9 includes, for example, a liquid crystal display with a touch panel and displays states of the outboard motors 3, various operation screens, etc. The operation panel 8 includes two key switches 81P and 81S ("key switch 81," when referred to collectively below) respectively corresponding to the two outboard motors 3P and 3S.

The key switches 81P and 81S are switches that are operated to turn on and off power supplies to the outboard motors 3P and 3S, respectively, and to start the engines of the outboard motors 3P and 3S, respectively. Specifically, by operating a key switch 81 from an off position to an on position, the power supply to the corresponding outboard motor 3 can be turned on. Further, by operating the key switch 81 from the on position to the start position, the engine of the corresponding outboard motor 3 can be started. Also, by operating the key switch 81 from the on position to the off position, the power supply to the corresponding outboard motor 3 can be put in the off state.

Figure 3:
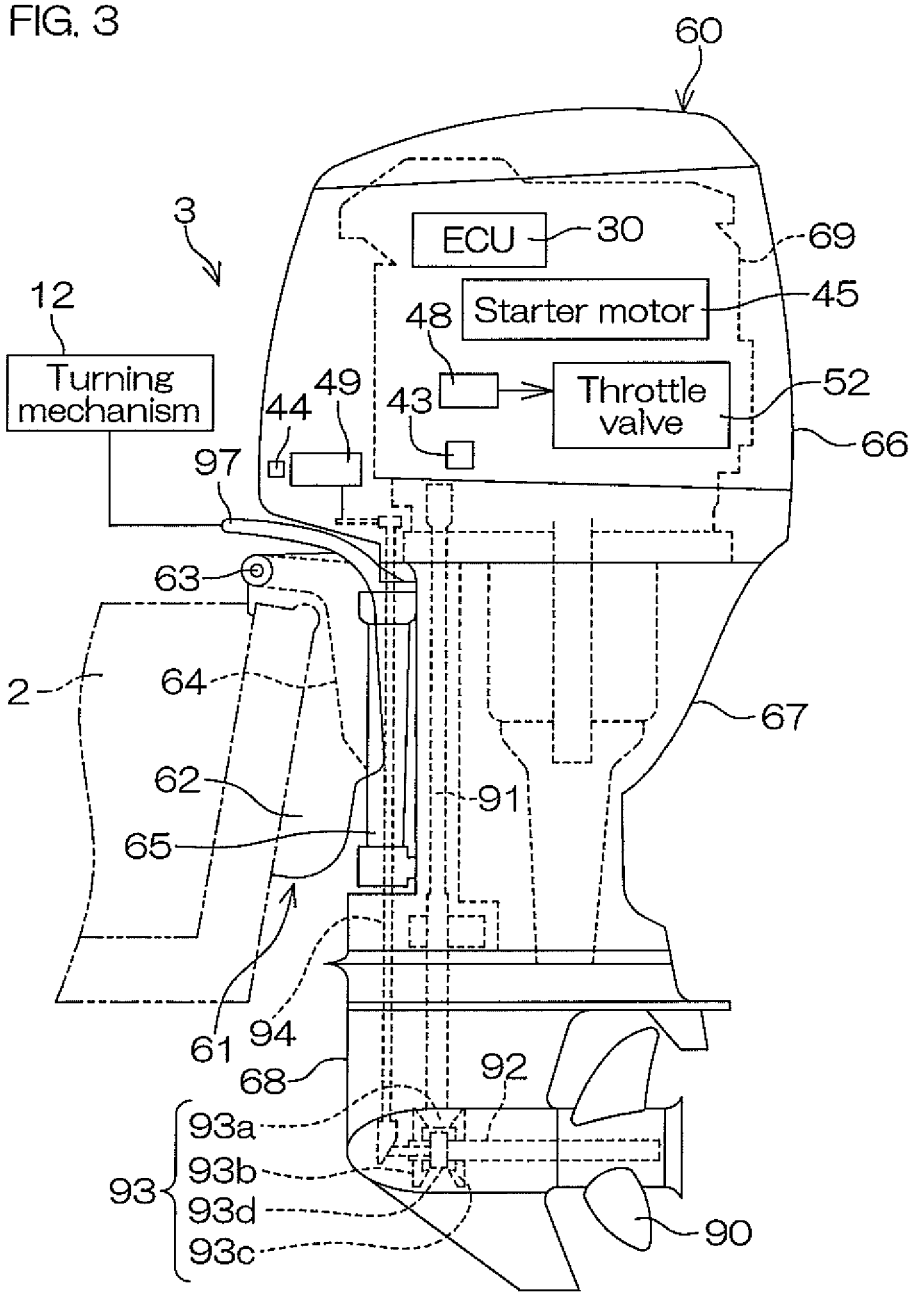
FIG. 3 is a schematic side view of an arrangement example of an outboard motor

FIG. 3 is a schematic side view illustrating an arrangement example in common to the two outboard motors 3.

Each outboard motor 3 includes a propulsion unit 60 and an attachment mechanism 61 arranged to attach the propulsion unit 60 to the hull 2. The attachment mechanism 61 includes a clamp bracket 62 detachably fixed to a transom of the hull 2 and a swivel bracket 64 coupled to the clamp bracket 62 in a manner enabling pivoting around a tilt shaft 63 as a horizontal pivot axis. The propulsion unit 60 is attached to the swivel bracket 64 in a manner enabling pivoting around a steering shaft 65. Thus, a turning angle (a direction angle defined by the direction of the propulsive force with respect to a centerline of the hull 2) can be changed by pivoting the propulsion unit 60 around the steering shaft 65. Further, a trim angle of the propulsion unit 60 can be changed by pivoting the swivel bracket 64 around the tilt shaft 63. The trim angle corresponds to an angle of attachment of the outboard motor 3 with respect to the hull 2.

A housing of the propulsion unit 60 includes a top cowling 66, an upper case 67, and a lower case 68. An engine 69 is installed as a drive source in the top cowling 66 with an axis of a crankshaft thereof extending vertically. A driveshaft 91 for power transmission is coupled to a lower end of the crankshaft of the engine 69 and vertically extends through the upper case 67 into the lower case 68.

A propeller 90, which is a propulsive force generating member, is rotatably attached to a rear side of a lower portion of the lower case 68. A propeller shaft 92, which is a rotation shaft of the propeller 90, extends horizontally in the lower case 68. The rotation of the driveshaft 91 is transmitted to the propeller shaft 92 via a shift mechanism 93, which is a clutch mechanism.

The shift mechanism 93 includes a drive gear 93*a*, defined by a beveled gear fixed to a lower end of the driveshaft 91, a forward drive gear 93*b*, defined by a beveled gear rotatably disposed on the propeller shaft 92, a reverse drive gear 93*c*, likewise defined by a beveled gear rotatably disposed on the propeller shaft 92, and a dog clutch 93*d* disposed between the forward drive gear 93*b* and the reverse drive gear 93*c*.

The forward drive gear 93*b* is meshed with the drive gear 93*a* from a front side, and the reverse drive gear 93*c* is meshed with the drive gear 93*a* from a rear side. The forward drive gear 93*b* and the reverse drive gear 93*c* are thus rotated in mutually opposite directions.

The dog clutch 93*d* is in spline engagement with the propeller shaft 92. That is, the dog clutch 93*d* is axially slidable with respect to the propeller shaft 92, but is not rotatable relative to the propeller shaft 92 and thus rotates together with the propeller shaft 92.

The dog clutch 93*d* is slid along the propeller shaft 92 by axial pivoting of a shift rod 94, extending vertically parallel or substantially parallel to the driveshaft 91. The shift position of the dog clutch 93*d* is thus controlled to be set at a forward drive position at which it is engaged with the forward drive gear 93*b*, a reverse drive position at which it is engaged with the reverse drive gear 93*c*, or a neutral position at which it is not engaged with either the forward drive gear 93*b* or the reverse drive gear 93*c*.

When the dog clutch 93*d* is at the forward drive position, the rotation of the forward drive gear 93*b* is transmitted to the propeller shaft 92 via the dog clutch 93*d*. The propeller 90 is thus rotated in one direction (forward drive direction) to generate a propulsive force in a direction of moving the hull 2 forward. On the other hand, when the dog clutch 93*d* is at the reverse drive position, the rotation of the reverse drive gear 93*c* is transmitted to the propeller shaft 92 via the dog clutch 93*d*. The reverse drive gear 93*c* is rotated in a direction opposite to that of the forward drive gear 93*b*, and the propeller 90 is thus rotated in an opposite direction (reverse drive direction) to generate a propulsive force in a direction of moving the hull 2 in reverse. When the dog clutch 93*d* is at the neutral position, the rotation of the driveshaft 91 is not transmitted to the propeller shaft 92. That is, transmission path of a driving force between the engine 69 and the propeller 90 is cut off so that a propulsive force is not generated in either direction.

In relation to each engine 69, a starter motor 45 is disposed to start the engine 69. The starter motor 45 is controlled by the outboard motor ECU 30. Also, a throttle actuator 48 is provided to actuate a throttle valve 52 of the engine 69 to change a throttle opening degree and thus change an intake air amount of the engine 69. The throttle actuator 48 may include an electric motor. The operation of the throttle actuator 48 is controlled by the outboard motor ECU 30. The engine 69 further includes an engine speed sensor 43 to detect the rotation of the crankshaft so as to detect the rotational speed of the engine 69.

Also, in relation to the shift rod 94, a shift actuator 49 to change the shift position of the dog clutch 93*d* is provided. The shift actuator 49 includes, for example, an electric motor, and operation thereof is controlled by the outboard motor ECU 30. In relation to the shift actuator 49, a shift position sensor 44 that detects the shift position of the shift mechanism 93 is provided.

The turning mechanism 12 is coupled to a steering arm 97 fixed to the propulsion unit 60. By operating the turning mechanism 12, the propulsion unit 60 is pivoted to the right and left around the steering shaft 65 and steering of the marine vessel 1 can thus be performed.

FIG. 4 is an arrangement diagram of an arrangement example of the turning mechanism.

The turning mechanism 12 is preferably a hydraulic turning mechanism. The turning mechanism 12 includes a hydraulic pump 101, an electric motor 102 to drive the hydraulic pump 101, and a hydraulic cylinder 103.

The hydraulic cylinder 103 is preferably a double-rod type double acting cylinder. The hydraulic cylinder 103 includes a cylinder tube 104, a piston 105 provided inside the cylinder tube 104, and a piston rod 106 connected to the piston 105. The cylinder tube 104 and the piston rod 106 extend in a right/left direction. A space inside the cylinder tube 104 is partitioned by the piston 105 into a first cylinder chamber 107 at the left side and a second cylinder chamber 108 at the right side. The piston 105 is capable of moving relatively to the right and left inside the cylinder tube 104. Actually, the a right/left position of the piston 105 is fixed with respect to the hull 2 and the cylinder tube 104 moves to the right and left with respect to the piston 105.

The first cylinder chamber 107 is connected to a first port of the hydraulic pump 101 via a first oil passage 109. The second cylinder 108 is connected to a second port of the hydraulic pump 101 via a second oil passage 110.

One end portion and another end portion of the piston rod 106 respectively project axially outward from one end portion and another end portion of the cylinder tube 104. The one end portion and the other end portion of the piston rod 106 are respectively coupled to two fixed arms 111. The two fixed arms 111 are fixed to the swivel bracket 64. The piston rod 106 is thus attached to the hull 2 via the swivel bracket 64 and the clamp bracket 62 (see FIG. 3). The cylinder tube 104 is coupled to the steering arm 97 fixed to the outboard motor 3. The cylinder tube 104 is guided by the piston rod 106 and is thus enabled to move in the right and left directions with respect to the hull 2. The outboard motor 3 pivots to the right and left around the steering shaft 65 in accompaniment with the movement of the cylinder tube 104 in the right and left directions.

In the description that follows, a turning angle midpoint of an outboard motor 3 is a position of the outboard motor 3 at which a rotation axis Ap of the propeller 90 of the outboard motor 3 is parallel or substantially parallel to a straight line extending in a front/rear direction of the hull 2 in a plan view. Also, a position of the cylinder tube 104 with respect to the hull 2 when the outboard motor 3 is positioned at the turning angle midpoint shall be referred to as the turning angle midpoint position of the cylinder tube 104.

The turning angle sensor 112 to detect the actual turning angle of the outboard motor 3 is provided in a vicinity of the hydraulic cylinder 103. The turning angle sensor 112 detects an amount of movement of the cylinder tube 104 in both right and left directions from the turning angle midpoint position of the cylinder tube 104. The turning angle sensor 112, for example, outputs the amount of movement of the cylinder tube 104 in the left direction from the turning angle midpoint position as a positive value and outputs the amount of movement in the right direction from the turning angle midpoint position as a negative value. The turning angle of the outboard motor 3 can be detected based on the movement amount of the cylinder tube 104 from the turning angle midpoint position that is detected by the turning angle sensor 112.

When the turning angle sensors 112 provided in the turning mechanisms 12 of the respective outboard motors 3P and 3S are to be distinguished, the turning angle sensor corresponding to the port outboard motor 3P shall be referred to as the "turning angle sensor 112P" and the turning angle sensor corresponding to the starboard outboard motor 3S shall be referred to as the "turning angle sensor 112S."

A first pilot check valve 113 is provided in a middle of the first oil passage 109. A second pilot check valve 114 is provided in a middle of the second oil passage 110. A pilot port of the first pilot check valve 113 is connected to a portion in the second oil passage 110 between the hydraulic pump 101 and the second pilot check valve 114. A pilot port of the second pilot check valve 114 is connected to a portion in the first oil passage 109 between the hydraulic pump 101 and the first pilot check valve 113.

The first pilot check valve 113 and the second pilot check valve 114 allow oil to flow through from the hydraulic pump 101 side to the hydraulic cylinder 103 side and block the flow of oil from the hydraulic cylinder 103 side to the hydraulic pump 101 side. However, each of the pilot check valves 113 and 114 is put in a state enabling reverse flow (flow through of oil from the hydraulic cylinder 103 side to the hydraulic pump 101 side) when a pilot pressure thereof become no less than a predetermined value.

The first oil passage 109 and the second oil passage 110 are connected, at portions closer to the hydraulic cylinder 103 than to the pilot check valves 113 and 114, by a bypass oil passage 116 including a bypass valve 115. In the present preferred embodiment, the bypass valve 115 preferably is a manually opened/closed bypass valve that is opened and closed manually and is normally in a closed state.

The first port of the hydraulic pump 101 is further connected via a first check valve 117 to an oil tank 121 and connected via a first relief valve 118 to the oil tank 121. Likewise, the second port of the hydraulic pump 101 is connected via a second check valve 119 to the oil tank 121 and connected via a relief valve 120 to the oil tank 121.

The electric motor 102 is driven to rotate in a forward rotation direction or a reverse rotation direction to drive the hydraulic pump 101. Specifically, an output shaft of the electric motor 102 is coupled to an input shaft of the hydraulic pump 101 and by rotation of the output shaft of the electric motor 102, the input shaft of the hydraulic pump 101 is rotated to achieve driving of the hydraulic pump 101. The electric motor 102 is, for example, a DC motor. When the electric motors 102 provided in the turning mechanisms 12 of the respective outboard motors 3P and 3S are to be distinguished, the electric motor corresponding to the port outboard motor 3P shall be referred to as the "electric motor 102P" and the electric motor corresponding to the starboard outboard motor 3S shall be referred to as the "electric motor 102S."

Current sensors 122P and 122S (see FIG. 5) to detect electric currents flowing through the electric motors 102P and 102S, respectively, are provided in drive circuits of the corresponding electric motors 102P and 102S. These shall be referred to as the "current sensor 122" when referred to collectively below.

When the electric motor 102 is rotated in the forward rotation direction, the hydraulic pump 101 is rotated forwardly and, for example, oil inside the oil tank 121 is sucked into the hydraulic pump 101 via the second check valve 119 and discharged from the hydraulic pump 101 to the first oil passage 109. The oil discharged to the first oil passage 109 is supplied via the first pilot check valve 113 and the first oil passage 109 to the first cylinder chamber 107 of the hydraulic cylinder 103. The cylinder tube 104 is thus moved in the left direction with respect to the hull 2 so that a volume of the first cylinder chamber 107 increases. Due to this process, the pilot pressure input into the second pilot check valve 114 becomes no less than the predetermined pressure and thus the second pilot check valve 114 is put in the state enabling reverse flow. The oil inside the second cylinder chamber 108 is thus sucked via the second oil passage 110 and the second pilot check valve 114 into the hydraulic pump 101.

When the electric motor 102 is rotated in the reverse rotation direction, the hydraulic pump 101 is rotated reversely and the oil inside the oil tank 121 is sucked into the hydraulic pump 101 via the first check valve 117 and discharged from the hydraulic pump 101 to the second oil passage 110. The oil discharged to the second oil passage 110 is supplied via the second pilot check valve 114 and the second oil passage 110 to the second cylinder chamber 108 of the hydraulic cylinder 103. The cylinder tube 104 is thus moved in the right direction with respect to the hull 2 so that a volume of the second cylinder chamber 108 increases. Due to this process, the pilot pressure input into the first pilot check valve 113 becomes no less than the predetermined pressure and thus the first pilot check valve 113 is put in the state enabling reverse flow. The oil inside the first cylinder chamber 107 is thus sucked via the first oil passage 109 and the first pilot check valve 113 into the hydraulic pump 101.

When the rotation of the electric motor 102 is stopped and the hydraulic pump 101 is not driven, the flow through of oil inside the cylinder chambers 107 and 108 of the hydraulic cylinder 103 is disabled by the pilot check valves 113 and 114. The movement of the cylinder tube 104 is thus disabled and the outboard motor 3 is put in a state of not being able to pivot around the steering shaft 65 (state of being fixed in turning angle).

FIG. 5 is a diagram illustrating an electrical arrangement of a principal portion of the marine vessel 1.

The operation panel 8, the operation display portion 9, the steering angle sensor 11, and the lever position sensors 13P and 13S are connected to the main ECU 10. Also, the main ECU 10 includes a service tool connection terminal 16. The service tool connection terminal 16 is a terminal arranged to connect a service tool 300 used during maintenance by a service person performing maintenance, etc. The service tool 300 may be a computer (personal computer) with a marine vessel maintenance program installed therein.

The main ECU 10 includes a computer (microcomputer) that includes a CPU and a memory (ROM, RAM, nonvolatile memory). The main ECU 10 is connected to a bus 15 that defines an inboard LAN (local area network). Also, a speed sensor 14 to detect a speed of the marine vessel 1 is connected to the bus 15.

The outboard motors 3S and 3P include outboard motor ECUs 30P and 30S, respectively. The outboard motor ECU 30P corresponds to the port outboard motor 3P and the outboard motor ECU 30S corresponds to the starboard outboard motor 3S. The outboard motor ECUs 30P and 30S are connected to the bus 15. The outboard motor ECUs 30S and 30P are practically the same in internal arrangement and shall be referred to as the "outboard motor ECU 30" when referred to collectively below.

Each outboard motor ECU 30 includes a computer (microcomputer) that includes a CPU and a memory (ROM, RAM, nonvolatile memory). A temperature sensor 41, a hydraulic pressure sensor 42, the engine speed sensor 43, the shift position sensor 44, a starter motor 45, an ignition coil 46, an injector 47, the throttle actuator 48, the shift actuator 49, a fuel pump 50, an oil pump 51, etc., are connected to the outboard motor ECU 30.

The starter motor 45 is a device to perform cranking of the engine. The injector 47 is a device that injects fuel into an air intake path of the engine. The throttle actuator 48 is a device that controls the throttle valve 52 to adjust the amount of air supplied to the air intake path of the engine. The ignition coil 46 is device that increases a voltage applied to a spark plug (not shown). The spark plug is a device that discharges inside a combustion chamber of the engine to ignite a mixed gas inside the combustion chamber. The shift actuator 49 is a device that drives the shift mechanism 93 of the outboard motor. The fuel pump 50 is a device that pumps out fuel from a fuel tank (not shown) to supply the fuel to the injector 47. The oil pump 51 is a device that circulates engine oil inside the engine.

The temperature sensor 41 detects a temperature of cooling water in the engine. The hydraulic pressure sensor 42 detects a pressure of the engine oil. The engine speed sensor 43 detects the rotational speed of the engine. The shift position sensor 44 detects the shift position of the shift mechanism 93 (shift position of the outboard motor).

The electric motors 102P and 102S, the turning angle sensors 112P and 112S, and the current sensors 122P and 122S of the turning mechanisms 12 respectively corresponding to the outboard motors 30P and 30S are connected to the turning ECU 20. The turning ECU 20 is connected to the bus 15. The turning ECU 20 includes drive circuits to drive the respective electric motors 102P and 102S and a computer (microcomputer) arranged and programmed to control the drive circuits. The computer includes a CPU and a memory (ROM, RAM, nonvolatile memory).

A straight traveling toe angle $\phi s$, which is the toe angle that is to be set during straight traveling of the marine vessel 1, is stored in a nonvolatile memory 204 (see FIG. 6) of the turning ECU 20. The nonvolatile memory 204 is preferably an EEPROM or other rewritable nonvolatile memory. The straight traveling toe angle $\phi s$ is set to an angle such that the electric currents flowing through the two electric motors 102 during the straight travel of the marine vessel 1 are significantly reduced or minimized. In the present preferred embodiment, the straight traveling toe angle $\phi s$ is set to an angle such that a sum of time average values of the electric currents flowing through the respective electric motors 102 during the straight travel of the marine vessel 1 is significantly reduced or minimized. The straight traveling toe angle $\phi s$ is determined and set by a test run of the marine vessel 1. In the present preferred embodiment, the straight traveling toe angle $\phi s$ can be set or changed later when necessary.

The computer of the main ECU 10 executes programs to achieve the functions of a plurality of function processing units. The function processing units include an electric power supply/starting control unit, a shift position etc., computing unit, a basic target turning angle computing unit, a toe angle setting/changing unit, and a current value outputting unit.

Functions of the main ECU 10 as the electric power supply/starting control unit include performing, on the basis of an operation signal from a key switch 81 on the operation panel 8, on/off control of the electric power supply of the corresponding outboard motor 3 and starting control of the engine of the corresponding outboard motor 3. Functions of the main ECU 10 as the shift position etc., computing unit include performing a shift position etc., computing process of computing target shift positions and target engine speeds of the respective outboard motors 3 based on outputs of the lever position sensors 13P and 13S. A function of the main ECU 10 as the basic target turning angle computing unit is to compute basic target turning angles of the respective outboard motors 3 based on an output of the steering angle sensor 11. A function of the main ECU 10 as the toe angle setting/changing unit is to perform a process to set or change the straight traveling toe angle. A function of the main ECU 10 as the current value outputting unit is to perform a process to externally output the motor current values detected by the respective current sensors 122.

These functions shall now be described in detail.

The functions of the main ECU 10 as the electric power supply/starting control unit areas follows. That is, when a key switch 81 is operated from the off position to the on position, the main ECU 10 turns on the electric power supply of the corresponding outboard motor ECU 30. Also, when the key switch 81 is operated from the on position to the off position, the main ECU 10 turns off the electric power supply of the corresponding outboard motor 3. Also, when the key switch 81 is operated from the on position to the start position, the main ECU 10 outputs an engine starting command to the corresponding outboard motor ECU 30 under a condition that the starting allowing conditions are met. The starting allowing conditions include the target shift position of the outboard motor 3, computed by the main ECU 10, is the neutral position and the actual shift position of the shift mechanism 93 of the corresponding outboard motor 3 is the neutral position. Information on the shift position of the shift mechanism 93 of each outboard motor 3 is sent from the corresponding outboard motor ECU 30 to the main ECU 10 via the bus 15.

Upon receiving the engine starting command, the outboard motor ECU 30 performs an engine starting process. In the engine starting process, the engine ECU 30 drives the starter motor 45, the ignition coil 46, and the injector 47 to perform fuel supply control and ignition control to start the engine.

Functions of the main ECU 10 as the shift position etc., computing unit shall now be described. Based on the output signals of the lever position sensors 13S and 13P, the main ECU 10 computes the target shift positions and the target engine speeds for the respective outboard motors 3 and transmits these to the corresponding outboard motor ECUs 30. Each outboard motor ECU 30 controls the shift position and the engine speed of the corresponding outboard motor 3 based on the target shift position and the target engine speed that are transmitted from the main ECU 10. Specifically, the outboard motor ECU 30 controls the shift actuator 49 so that the shift position of the outboard motor 3 becomes the target shift position and controls the throttle actuator 48 so that the engine speed becomes the target engine speed. Such control shall now be described in detail.

The shift position of each outboard motor 3 is controlled as follows. In the present preferred embodiment, the left lever 7P is associated with the port outboard motor 3P and the right lever 7S is associated with the starboard outboard motor 3S.

When the left lever 7P is inclined forward by no less than a predetermined amount from a predetermined neutral position, the shift position of the port outboard motor 3P is set to the forward drive position and a propulsive force in the forward drive direction is generated from the corresponding outboard motor 3P. The target engine speed is set at an idling engine speed up to the inclination position of the predetermined amount (forward drive shift-in position). When the left lever 7P is inclined forward beyond the forward drive shift-in position, the target engine speed is set to increase as the lever inclination amount increases. When the left lever 7P is inclined rearward by no less than a predetermined amount from the neutral position, the shift position of the port outboard motor 3P is set at the reverse drive position and a propulsive force in the reverse drive direction is generated from the port outboard motor 3P. The target engine speed is set at the idling engine speed up to the inclination position of the predetermined amount (reverse drive shift-in position). When the left lever 7P is inclined rearward beyond the reverse drive shift-in position, the target engine speed is set to increase as the lever inclination amount increases. When the left lever 7P is at the neutral position, the shift position of the port outboard motor 3P is set at the neutral position and the outboard motor 3P does not generate a propulsive force.

When the right lever 7S is operated, the shift position and the engine speed of the starboard outboard motor 3S are controlled in the same manner as in the above-described control of the shift position and the engine speed of the port outboard motor 3P that is performed when the left lever 7P is operated.

The functions of the main ECU 10 as the basic target turning angle computing unit, the toe angle setting/changing unit, and the current value outputting unit shall be described below.

The computer of each outboard motor ECU 30 executes programs to achieve the functions of a plurality of function processing units. The plurality of function processing units include an engine starting process unit, a shift control unit, etc. A function of the outboard motor ECU 30 as the engine starting process unit is to perform the engine starting process described above. A function of the outboard motor ECU 30 as a shift control unit is to control the engine speed and the shift position based on the target engine speed and the target shift position computed by the main ECU 10.

The computer of the turning ECU 20 executes programs to achieve the functions of a plurality of function processing units. The plurality of function processing units include a motor control unit, a current value transmitting unit, etc. A function of the turning ECU 20 as the motor control unit is to control the electric motors 102 of the turning mechanisms 12 of the respective outboard motors 3 based on the basic target turning angle computed by the main ECU 10. A function of the turning ECU 20 as the current value transmitting unit is to transmit the motor current values detected by the current sensors 122P and 122S to the main ECU 10 via the bus 15.

Figure 6:
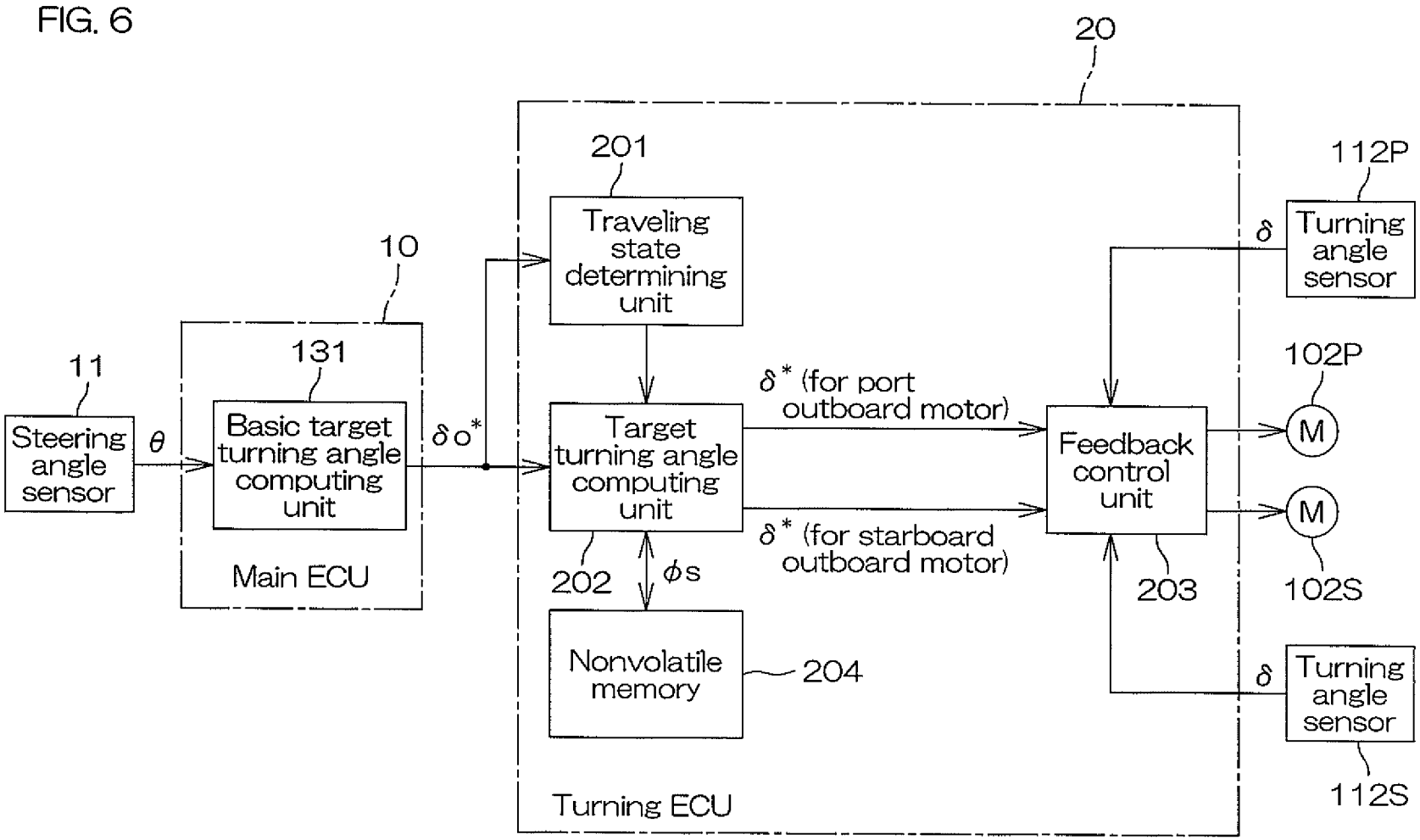
FIG. 6 is a block diagram illustrating a function of a main ECU as a reference target turning angle computing unit and a function of a turning ECU as an electric motor control unit.

The function of the main ECU 10 as the basic target turning angle computing unit and the function of the turning ECU 20 as the motor control unit shall now be described with reference to FIG. 6.

The main ECU 10 includes a basic target turning angle computing unit 131. The basic target turning angle computing unit 131 computes a basic target turning angle $\delta o^*$ in common to both outboard motors 3 based on a steering angle $\theta$ detected by the steering angle sensor 11 and transmits it to the turning ECU 20. The basic target turning angle computing unit 131, for example, computes the basic target turning angle $\delta o^*$ corresponding to the steering angle $\theta$, detected by the steering angle sensor 11, based on a map in which a relationship between the steering angle $\theta$ and the basic target turning angle $\delta o^*$ is stored in advance.

The turning ECU 20 includes a traveling state determining unit 201, a target turning angle computing unit 202, and a feedback control unit 203.

The traveling state determining unit 201 determines whether or not the traveling state of the marine vessel 1 is the straight traveling state. Specifically, the traveling state determining unit 201 determines whether or not the traveling state of the marine vessel 1 is the straight traveling state based on whether or not the basic target turning angle δo* computed by the basic target turning angle computing unit 131 is within a predetermined angular range set in advance. More specifically, the traveling state determining unit 201 determines whether or not an absolute value |δo*| of the received basic target turning angle δo* is no more than a predetermined value A (A>0) and determines that the traveling state of the marine vessel 1 is the straight traveling state if the absolute value |δo*| of the received basic target turning angle δo* is no more than the predetermined value A. The predetermined value A is set, for example, to be about 5 degrees.

The target turning angle computing unit 202 computes target turning angles δ* of the respective outboard motors 3 based on the determination result of the traveling state determining unit 201 and the basic target turning angle δo* computed by the basic target turning angle computing unit 131.

An operation of the target turning angle computing unit 202 in a case where the traveling state determining unit 201 determines that the traveling state of the marine vessel 1 is the straight traveling state shall now be described. In this case, the target turning angle computing unit 202 computes, based on the basic target steering angle δo* and the straight traveling toe angle φs stored in the nonvolatile memory 204, the target turning angles δ* of the respective outboard motors 3 such that the toe angle between the two outboard motors 3 is equal to the straight traveling toe angle φs. Specifically, the target turning angle computing unit 202 adds φs/2 to the basic target turning angle δo* to compute the target turning angle δ* of one of the outboard motors 3 and subtracts φs/2 from the basic target turning angle δo* to compute the target turning angle δ* of the other outboard motor 3.

This point shall now be described more specifically. As mentioned above, the sign of the toe angle is negative in the case where the toe angle is a toe-in angle and is positive in the case where the toe angle is a toe-out angle. In the present preferred embodiment, the sign of the turning angle of each outboard motor 3 is set as follows. That is, when an outboard motor 3 is pivoted from the steering midpoint position in a direction for turning the hull 2 to the right (when the cylinder tube 104 is moved in the left direction from its steering midpoint position), the sign of the turning angle of the outboard motor 3 is positive. Also, when the outboard motor 3 is pivoted from the steering midpoint position in a direction for turning the hull 2 to the left (when the cylinder tube 104 is moved in the right direction from its steering midpoint position), the sign of the turning angle of the outboard motor 3 is negative. In the case where the signs of the toe angle and the turning angle are thus set, the target turning angle δ* of the port outboard motor 3P is computed by adding φs/2 to the basic target turning angle δo*. Also, the target turning angle δ* of the starboard outboard motor 3S is computed by subtracting φs/2 from the basic target turning angle δo*.

An operation of the target turning angle computing unit 202 in a case where the traveling state determining unit 201 determines that the traveling state of the marine vessel 1 is not the straight traveling state shall now be described. In this case, the target turning angle computing unit 202 computes the target turning angles δ* of the respective outboard motors 3 based on the basic target steering angle δo*. Specifically, the target turning angle computing unit 202 computes the target turning angles δ* of the respective outboard motors 3 corresponding to the received basic target turning angle δo* based, for example, on a map in which a relationship between the basic target turning angle δo* and the target steering angles δ* of the respective outboard motors 3 is stored in advance. The target turning angle computing unit 202 may use the received basic target turning angle δo* as it is as each of the target steering angles δ* of the respective outboard motors 3.

The feedback control unit 203 uses the target steering angle δ* of each outboard motor 3 computed by the target turning angle computing unit 202 to perform feedback control of the electric motor 102 of the turning mechanism 12 of the corresponding outboard motor 3. Specifically, the feedback control unit 203 drives the electric motor 102 of the turning mechanism 12 of each outboard motor 3 so that the actual turning angle δ of the corresponding outboard motor 3 detected by the turning angle sensor 112 approaches the target turning angle δ* of the corresponding outboard motor 3. The turning angles of the respective outboard motors 3 are thus controlled in accordance with the steering angle of the steering handle 6.

As described above, when the traveling state of the marine vessel 1 is determined as being the straight traveling state by the traveling state determining unit 201, the target turning angles δ* of the respective outboard motors 3 are computed so that the toe angle between the two outboard motors 3 is equal to the straight traveling toe angle φs by the target turning angle computing unit 202. The straight traveling toe angle φs is set to an angle such that the electric currents flowing through the two electric motors 102 during the straight traveling of the marine vessel 1 are significantly reduced or minimized. The electric currents flowing through the electric motors 102 during the straight traveling of the marine vessel 1 correspond to an external force that acts on the outboard motors 3 during the straight traveling. The toe angle at which the electric currents are significantly reduced or minimized is thus a toe angle at which the external force acting on the outboard motors 3 is of a magnitude close to the minimum. The consumption of power during the straight traveling of the marine vessel 1 can thus be significantly reduced.

The function of the main ECU 10 as the toe angle setting/changing unit shall now be described. As an operation display mode of the operation display portion 9, a toe angle setting/changing mode is provided to set or change the straight traveling toe angle. When the operation display mode is set to the toe angle setting/changing mode by a service person, etc., operating the operation display portion 9 causes the main ECU 10 to display a toe angle setting/changing screen on the operation display portion 9. When the service person, etc., inputs a straight traveling toe angle in the toe angle setting/changing screen, the main ECU 10 changes (overwrites) the straight traveling toe angle, stored in the nonvolatile memory 204 of the turning ECU 20, to (with) the straight traveling toe angle that has been input. The straight traveling toe angle φs in the nonvolatile memory 204 is thus renewed (set or changed).

The function of the main ECU 10 as the current value outputting unit shall now be described. When the service tool 300 is connected to the service tool connection terminal 16 and a power supply of the service tool 300 is turned on, the service tool 300 and the main ECU 10 are put in a communication-enabled state. When a motor current value request command is transmitted from the service tool 300 to the main ECU 10 in this state, the main ECU 10 receives the motor current values, detected by the respective current sensors 122, from the turning CPU 20 and transmits these to the service tool 300. The service tool 300 displays the received motor current values on a display portion of the service tool 300. It thus becomes possible to monitor the motor current values, detected by the respective current sensors 122, at the service tool 300 side.

The service person, etc., can use the function of the main ECU 10 as the current value outputting unit to monitor the electric currents flowing through the respective electric motors 102 while actually making the marine vessel 1 undergo straight travel. Also, in this process, the service person, etc., can use the function of the main ECU 10 as the toe angle setting/changing unit to set or change the straight traveling toe angle $\phi s$. It thus becomes possible to monitor the electric currents with respect to a plurality of different straight traveling toe angles. The service person, etc., is thus enabled to determine a straight traveling toe angle $\phi s$ such that the electric currents flowing through the two electric motors 102 during the straight traveling are significantly reduced or minimized, and write the value thereof into the nonvolatile memory 204 of the turning ECU 20.

Figure 7:
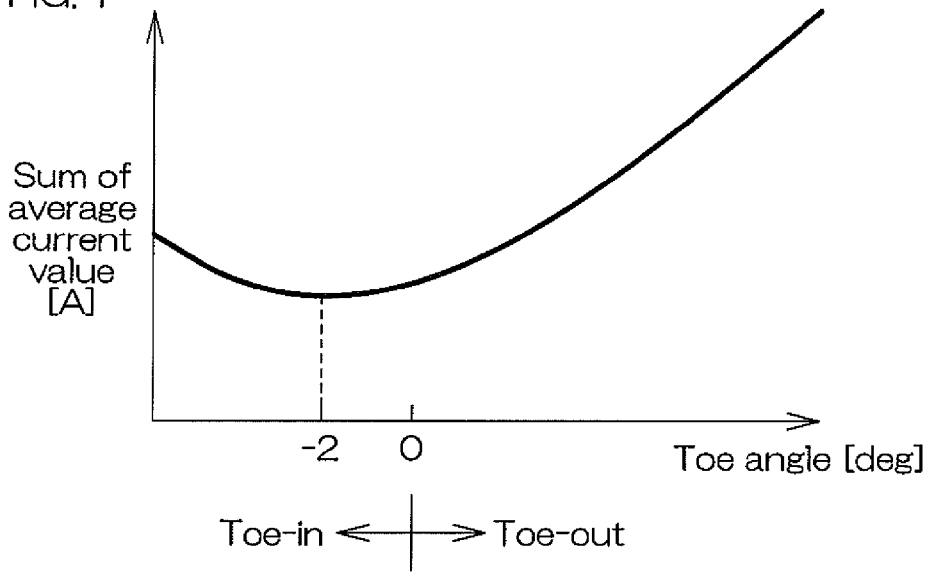
FIG. 7 is a graph of an example of a relationship between a toe angle during straight traveling and a sum of average values of electric currents (sum of average current values) flowing through two electric motors respectively provided in two turning mechanisms.
Figure 8A:
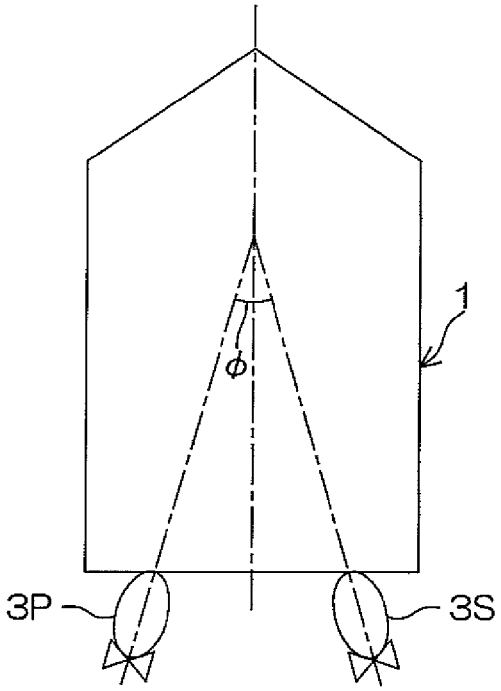
FIGS. 8A and 8B are schematic views illustrating the toe angle.
Figure 8B:
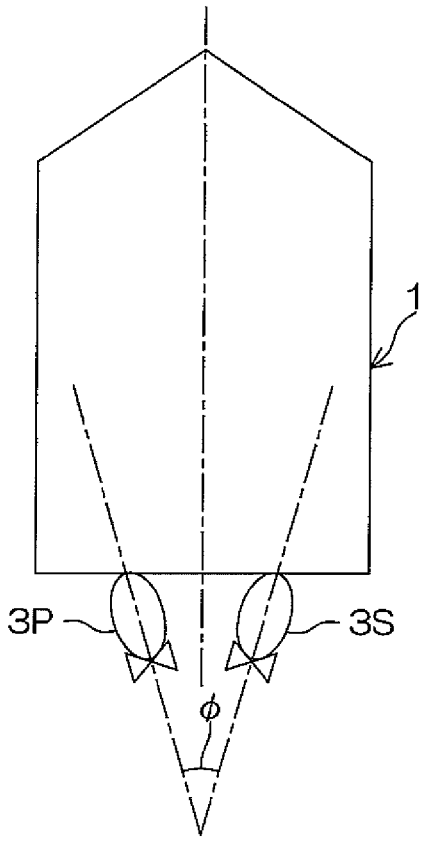

FIG. 7 is a graph of an example of a relationship between the toe angle during straight traveling and a sum of time average values of the electric currents (sum of average current values) flowing through the two electric motors 102. Such a graph is prepared by the service person, etc., by the above-described method for a marine vessel, for which a cross-section perpendicular to a front/rear direction of the marine vessel at a hull bottom of a rear portion of a hull preferably has a V-shape, for example, as in the present preferred embodiment. In the non-limiting example of FIG. 7, the sum of the average values of the electric currents flowing through the two electric motors 102 is the minimum when the toe angle preferably is −2 degrees (toe-in), for example. Thus, in a non-limiting example of a case in which such characteristics are obtained, the straight traveling toe angle is preferably set to −2 degrees, for example.

A reason why the sum of the average values of the electric currents flowing through the two electric motors 102 is the minimum in the toe-in state shall now be described. With the marine vessel with which the characteristics of FIG. 7 were obtained, the cross-section perpendicular to the front/rear direction of the marine vessel at the hull bottom of the rear portion of the hull preferably has a V-shape, for example. Thus, near the rear portion of the hull, a water stream flows obliquely outward to the rear from a width center of the hull as viewed from above during straight traveling of the marine vessel. By setting the toe angle between the two outboard motors so that propeller axes of the two outboard motors are parallel or substantially parallel to the direction of the water stream, the external force that acts on the two outboard motors during the straight traveling can be significantly reduced or minimized. A toe angle that satisfied such a condition is a toe-in angle with which the front ends of the two outboard motors 3 are directed inward.

Although preferred embodiments of the present invention have been described above, the present invention can be carried out in yet other modes as well. For example, with the preferred embodiments described above, the traveling state determining unit 201 preferably determines whether or not the traveling state of the marine vessel 1 is the straight traveling state based on whether or not the basic target turning angle $\delta o^*$ is within the predetermined angular range set in advance. However, the traveling state determining unit 201 may instead determine whether or not the traveling state of the marine vessel 1 is the straight traveling state based on whether or not the steering angle $\theta$ detected by the steering angle sensor 11 is within a predetermined angular range set in advance.

Also, with the preferred embodiments described above, the function of the main ECU 10 as the current value outputting unit is preferably to perform the process to externally output the motor current values detected by the respective current sensors 122. However, the function of the main ECU 10 as the current value outputting unit may instead be to perform a process to display the motor current values, detected by the respective current sensors 122, on the operation display portion 9.

Specifically, a current value monitoring mode to display the motor current values, detected by the respective current sensors 122, on the operation display portion 9 may be prepared as an operation display mode of the operation display portion 9. In this case, when the operation display mode is set to the current value monitoring mode by the service person, etc., operating the operation display portion 9 causes the main ECU 10, for example, to receive the motor current values, detected by the respective current sensors 122, from the turning CPU 20 and to display the values on the operation display portion 9 at every predetermined time.

Also, although in the preferred embodiments described above, the turning mechanism 12 is preferably arranged to control the turning direction of the outboard motor by a rotation direction of the hydraulic pump 101, an arrangement is also possible where a directional control valve, driven by an electric motor, is provided between the hydraulic pump 101 and the hydraulic cylinder 103. With an arrangement provided with such a directional control valve, the hydraulic pump 101 is always rotatingly driven in a fixed direction and the turning direction of the outboard motor is controlled by control of the electric motor to drive the directional control valve. Further, the turning mechanism 12 may be a turning mechanism other than a hydraulic type as long as it is of an arrangement that includes an electric motor that is controlled in accordance with an operation of the steering handle 6 (steering member). An example of such a steering mechanism is disclosed in FIG. 3 of U.S. 2007/0207683 A1.

Also, although in the preferred embodiment described above, the turning mechanisms 12 of the two outboard motors 3 are preferably controlled by a single turning ECU 20 in common thereto, the turning mechanisms 12 may instead be controlled by a plurality of turning ECUs provided in respective correspondence to the plurality of outboard motors 3.

Also, although with the preferred embodiments described above, a case where the motor of each outboard motor is an engine was described, the motor of each outboard motor may instead be an electric motor.

Also, although with the preferred embodiments described above, two outboard motors are preferably provided, no less than three outboard motors may be provided instead. For example, in a case where three outboard motors are provided, the turning angles may be controlled so that a toe angle between the two outboard motors at the respective sides is equal to the straight traveling toe angle during straight traveling. Also, for example, in a case where four outboard motors are provided, the turning angles may controlled so that a toe angle between the two outer outboard motors and a toe angle between the two inner outboard motors are respectively equal to the straight traveling toe angle during straight traveling.

Besides the above, various design changes may be applied within the scope of the matters described in the claims.

A non-limiting example of the correspondence between the components described in the claims and the components of the preferred embodiments described above is shown below:

motor: engine 69 steering member: steering handle 6 motor control unit: turning ECU 20, traveling state determining unit 201, target turning angle computing unit 202, feedback control unit 203 steering angle detecting unit: steering angle sensor 11 actual turning angle detecting unit: turning angle sensors 112P and 112S current detecting unit: current sensors 122P and 122S current value outputting unit: turning ECU 20, main ECU 10, service tool connection terminal 16, operation display portion 9 toe angle setting/changing unit: main ECU 10, operation display portion 9

The present application corresponds to Japanese Patent Application No. 2012-228657 filed on Oct. 16, 2012 in the Japan Patent Office, and the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A steering system for a marine vessel that includes at least two outboard motors, each of the least two outboard motors including a motor and a propeller rotated by the motor, the marine vessel steering system comprising:

a steering member;

at least two turning mechanisms respectively arranged to turn the at least two outboard motors individually and each of the at least two turning mechanisms including an electric motor driven in accordance with an operation of the steering member; and an electric motor control unit arranged and programmed to control the at least two electric motors so that during straight traveling of the marine vessel a toe angle between the at least two outboard motors is equal to a straight traveling toe angle set in advance; wherein the straight traveling toe angle is set to an angle such that electric currents flowing through the at least two electric motors during the straight traveling of the marine vessel are minimized.

2. The marine vessel steering system according to claim 1, further comprising:

a steering angle detecting unit arranged to detect a steering angle of the steering member;

a plurality of actual turning angle detecting units arranged to detect actual turning angles of the at least two outboard motors; and a basic target turning angle computing unit arranged and programmed to compute a basic target turning angle based on the steering angle detected by the steering angle detecting unit; wherein the electric motor control unit includes:

a traveling state determining unit arranged to determine whether or not the traveling state of the marine vessel is the straight traveling state;

a target turning angle computing unit arranged and programmed to compute target turning angles of the at least two outboard motors based on the determination result of the traveling state determining unit and the basic target turning angle computed by the basic target turning angle computing unit; and a feedback control unit arranged and programmed to control the at least two electric motors so that the actual turning angles of the at least two outboard motors detected by the actual turning angle detecting unit approach the target turning angles of the at least two outboard motors computed by the target turning angle computing unit; wherein when the traveling state determining unit determines that the traveling state is the straight traveling state, the target turning angle computing unit computes, based on the basic target turning angle computed by the basic target turning angle computing unit and the straight traveling toe angle, the target turning angles of the at least two outboard motors such that the toe angle between the at least two outboard motors is equal to the straight traveling toe angle; and when the traveling state determining unit determines that the traveling state is not the straight traveling state, the target turning angle computing unit computes the target turning angles of the at least two outboard motors based on the basic target turning angle computed by the basic target turning angle computing unit.

3. The marine vessel steering system according to claim 2, wherein the traveling state determining unit is arranged to determine whether or not the traveling state is the straight traveling state based on whether or not the basic target turning angle computed by the basic target turning angle computing unit is within a predetermined angular range set in advance.

4. The marine vessel steering system according to claim 1, further comprising:

at least two current detecting units arranged to detect the electric currents of the at least two electric motors;

a current value outputting unit arranged to display or externally output the motor current values detected by the at least two current detecting units; and a toe angle setting/changing unit arranged to set or change the straight traveling toe angle.

5. The marine vessel steering system according to claim 2, further comprising:

at least two current detecting units arranged to detect the electric currents of the at least two electric motors;

a current value outputting unit arranged to display or externally output the motor current values detected by the at least two current detecting units; and a toe angle setting/changing unit arranged to set or change the straight traveling toe angle.

6. The marine vessel steering system according to claim 3, further comprising:

at least two current detecting units arranged to detect the electric currents of the at least two electric motors;

a current value outputting unit arranged to display or externally output the motor current values detected by the at least two current detecting units; and a toe angle setting/changing unit arranged to set or change the straight traveling toe angle.

7. The marine vessel steering system according to claim 1, wherein the angle at which the electric currents flowing through the at least two electric motors are minimized, is a toe-in angle in which front ends of the at least two outboard motors are directed inward.

8. The marine vessel steering system according to claim 2, wherein the angle at which the electric currents flowing through the at least two electric motors are minimized, is a toe-in angle in which front ends of the at least two outboard motors are directed inward.

9. The marine vessel steering system according to claim 3, wherein the angle at which the electric currents flowing through the at least two electric motors are minimized, is a toe-in angle in which front ends of the at least two outboard motors are directed inward.

10. The marine vessel steering system according to claim 4, wherein the angle at which the electric currents flowing through the at least two electric motors are minimized, is a toe-in angle in which front ends of the at least two outboard motors are directed inward.

11. The marine vessel steering system according to claim 5, wherein the angle at which the electric currents flowing through the at least two electric motors are minimized, is a toe-in angle in which front ends of the at least two outboard motors are directed inward.

12. The marine vessel steering system according to claim 6, wherein the angle at which the electric currents flowing through the at least two electric motors are minimized, is a toe-in angle in which front ends of the at least two outboard motors are directed inward.

13. The marine vessel steering system according to claim 7, wherein a cross-section, perpendicular to a front/rear direction of the marine vessel, of a hull bottom at a rear portion of a hull of the marine vessel has a V-shape.

14. The marine vessel steering system according to claim 8, wherein a cross-section, perpendicular to a front/rear direction of the marine vessel, of a hull bottom at a rear portion of a hull of the marine vessel has a V-shape.

15. The marine vessel steering system according to claim 9, wherein a cross-section, perpendicular to a front/rear direction of the marine vessel, of a hull bottom at a rear portion of a hull of the marine vessel has a V-shape.

16. The marine vessel steering system according to claim 10, wherein a cross-section, perpendicular to a front/rear direction of the marine vessel, of a hull bottom at a rear portion of a hull of the marine vessel has a V-shape.

17. The marine vessel steering system according to claim 11, wherein a cross-section, perpendicular to a front/rear direction of the marine vessel, of a hull bottom at a rear portion of a hull of the marine vessel has a V-shape.

18. The marine vessel steering system according to claim 12, wherein a cross-section, perpendicular to a front/rear direction of the marine vessel, of a hull bottom at a rear portion of a hull of the marine vessel has a V-shape.

* * * * *